US009540199B2

(12) United States Patent
Wang et al.

(10) Patent No.: US 9,540,199 B2
(45) Date of Patent: Jan. 10, 2017

(54) AUTOMATIC TELLER MACHINE AND DEFLECTION CORRECTING APPARATUS THEREOF

(71) Applicant: GRG Banking Equipment Co., Ltd., Guangzhou, Guangdong (CN)

(72) Inventors: Peng Wang, Guangdong (CN); Zhe Li, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/780,978

(22) PCT Filed: Jul. 2, 2013

(86) PCT No.: PCT/CN2013/078677

§ 371 (c)(1),
(2) Date: Sep. 28, 2015

(87) PCT Pub. No.: WO2014/173013

PCT Pub. Date: Oct. 30, 2014

(65) Prior Publication Data

US 2016/0055700 A1 Feb. 25, 2016

(30) Foreign Application Priority Data

Apr. 23, 2013 (CN) ..... 2013 1 0143787

(51) Int. Cl.
*B65H 9/16* (2006.01)
*G07F 19/00* (2006.01)
(Continued)

(52) U.S. Cl.
CPC ..... *B65H 9/166* (2013.01); *B65H 5/38* (2013.01); *B65H 20/02* (2013.01); *B65H 23/18* (2013.01);
(Continued)

(58) Field of Classification Search
CPC ..... B65H 9/00; B65H 9/101; B65H 9/16; B65H 9/166; B65H 2301/331; B65H 2301/3114; B65H 2301/3412; B65H 2404/144; B65H 2404/6111; B65H 2701/1912; G07D 11/0027
(Continued)

(56) References Cited

U.S. PATENT DOCUMENTS 4,809,968 A * 3/1989 Malachowski ..... B65H 9/166 226/17
5,381,021 A 1/1995 Polidoro
(Continued)

FOREIGN PATENT DOCUMENTS

CN 1990367 A 7/2007
CN 102044109 A 5/2011
(Continued)

OTHER PUBLICATIONS

International Search Report, dated Jan. 30, 2014, from Corresponding International Application No. PCT/CN2013/078677.
(Continued)

*Primary Examiner* — Prasad Gokhale
(74) *Attorney, Agent, or Firm* — Wolf, Greenfield & Sacks, P.C.

(57) ABSTRACT

A deflection correcting device includes a banknote running passage formed by a first passage plate and a second passage plate, and a deflection correcting wheel is arranged inside the banknote running passage and has a deflection correcting direction deviated with respect to a reference wall of the banknote running passage. Multiple deflection correcting wheels are dispersedly arranged in a conveying direction of the banknote running passage and are arranged to gradually close to the reference wall. An adjusting wheel having a guide direction along a guide direction of the reference wall
(Continued)

is provided at the position of the reference wall, and the adjusting wheel is arranged between a first deflection correcting wheel and a second deflection correcting wheel in the multiple deflection correcting wheels. A linear speed of rotation of the adjusting wheel is greater than a linear speed of rotation of the respective deflection correcting wheel.

14 Claims, 4 Drawing Sheets

(51) Int. Cl.
*B65H 5/38* (2006.01)
*B65H 20/02* (2006.01)
*B65H 23/18* (2006.01)
*G07D 11/00* (2006.01)

(52) U.S. Cl.
CPC ..... *G07D 11/0027* (2013.01); *G07F 19/20* (2013.01); *G07F 19/202* (2013.01); *G07F 19/203* (2013.01); *B65H 2301/3114* (2013.01); *B65H 2301/331* (2013.01); *B65H 2301/3412* (2013.01); *B65H 2403/20* (2013.01); *B65H 2404/144* (2013.01); *B65H 2404/6111* (2013.01); *B65H 2701/1912* (2013.01)

(58) Field of Classification Search
USPC ..... 271/234, 248, 250, 251
See application file for complete search history.

(56) References Cited

U.S. PATENT DOCUMENTS 5,564,544 A 10/1996 Takemoto et al.
7,735,818 B2 * 6/2010 Fournier ..... B65H 1/06 271/165
7,900,914 B2 * 3/2011 Fujita ..... B65H 5/38 271/248
8,113,511 B2 * 2/2012 Kallin ..... B65H 9/166 271/228
8,205,879 B2 * 6/2012 Fujita ..... B65H 5/38 271/235
8,469,358 B1 * 6/2013 Wen ..... B65H 5/062 271/250
8,789,828 B2 * 7/2014 Wang ..... G07D 11/0027 271/251
2008/0284085 A1 11/2008 Curina et al.
2010/0327519 A1 12/2010 Miyazawa
2011/0042887 A1 * 2/2011 Kallin ..... B65H 9/166 271/227
2011/0074099 A1 * 3/2011 Kallin ..... B65H 9/166 271/225
2013/0334770 A1 * 12/2013 Fehrenbach ..... B65H 5/062 271/228
2014/0183816 A1 * 7/2014 Wang ..... G07D 11/0027 271/228

FOREIGN PATENT DOCUMENTS

CN 102324154 A 1/2012
CN 202265228 A 6/2012
JP 3901560 B2 4/2007
WO WO 2013/040931 A1 3/2013

OTHER PUBLICATIONS

Chinese Office Action, dated Sep. 1, 2014, from corresponding Chinese Application No. 201310143787.2.
Extended European Search Report, dated Apr. 26, 2016, from corresponding European Application No. 13882832.2.

* cited by examiner

AUTOMATIC TELLER MACHINE AND DEFLECTION CORRECTING APPARATUS THEREOF

This application is the national phase of International Application No. PCT/CN2013/078677, titled "AUTOMATIC TELLER MACHINE AND DEFLECTION CORRECTING APPARATUS THEREOF", filed on Jul. 2, 2013, which claims the benefit of priority to Chinese Patent Application No. 201310143787.2 titled "AUTOMATIC TELLER MACHINE AND DEFLECTION CORRECTING DEVICE THEREOF", filed with the Chinese State Intellectual Property Office on Apr. 23, 2013, each of which applications is incorporated herein by reference to the maximum extent allowable by law.

TECHNICAL FIELD

The present application relates to the technical field of automatic teller machines, and more specifically relates to an automatic teller machine and a deflection correcting device thereof.

BACKGROUND

In the process of depositing banknotes into an ATM (Automated Teller Machine), the banknotes are apt to be deflected when being put into a banknote depositing port of the ATM by a customer, thus a recognition module is required to perform defection correction on the banknotes put in the ATM.

A conventional deflection correcting device is shown in FIGS. 1 and 2, FIG. 1 is a schematic view showing the structure of a deflection correcting device according to the conventional technology, and FIG. 2 is a sectional schematic view of FIG. 1 taken along the direction A-A. The deflection correcting device includes a banknote running passage formed by arc-shaped passage plates (8') and (9'), a deflection correcting wheel (14'), a reference wall (**8*a*') and a polygonal adjusting wheel (19'). The deflection correcting wheel (14') is set to form a certain angle with the banknote running passage, to move the banknotes towards the reference wall (8*a*') at the same time when the banknotes are conveyed forward in the banknote running passage formed by the arc-shaped passage plates (8') and (9'), thereby correcting the banknotes. The banknotes are entered at the position (1') and are discharged at the position (2'**).

The polygonal adjusting wheel (19') presses one side, close to the reference wall, of the banknote downward, to loosen a top corner of the banknote that is in contact with the reference wall (**8*a*'). The resistance disappears when the top corner is loosened, and when the wheel presses the banknote downward, it also provides a resistance on the banknote to prevent the banknote from moving towards the reference wall (8*a*'), thus the banknote no longer moves towards the reference wall (8*a*'); at this time, since the speed of the adjusting wheel is greater than the speed of the deflection correcting wheel, the banknote may be deflected, and the top corner of the banknote may leave the reference wall (8*a*'**) gradually.

In the conventional deflection correcting device, it is noted in particular that two columns of deflection correcting wheels are arranged at the position of the first row of the deflection correcting wheels (14'), to ensure that the banknotes of certain size and specification are acted on two points synchronously when being clamped by the deflection correcting wheels (14'), thereby preventing the banknotes from generating a large deflection around the clamping point in the case that the single column of the deflection correcting wheel (14') acts on the banknote on one point.

In the deflection correcting device, the position relationship among the polygonal adjusting wheel (19'), an inlet conveying wheel (11') and the deflection correcting wheel (14') is fixed. After the banknotes enter into the deflection correcting device, two columns of deflection correcting wheels arranged at the position of the first row of the deflection correcting wheels (14') makes the banknotes unable to generate deflection, and in this case, the polygonal adjusting wheel (19') cannot act on the banknotes. The polygonal adjusting wheel (19') can only act on the banknotes until the banknotes leave the first row of the deflection correcting wheels (14'). Therefore, the conventional deflection correcting device needs a correction passage with enough length, and the length of the correction passage is in direct proportion to the length of the banknote or other valuable paper to be processed by the ATM.

Under the circumstance that the core structure of the ATM has a compact space, the space requirement of the conventional deflection correcting device is difficult to satisfy.

Therefore, a technical problem to be solved presently by those skilled in the art is to decrease a banknote conveying space of the deflection correcting device.

SUMMARY

In view of this, a technical problem to be solved by the present application is to decrease a banknote conveying space of a deflection correcting device.

For solving the above technical problem, the following technical solutions are provided by the present application.

A deflection correcting device includes a banknote running passage formed by a first passage plate and a second passage plate, and a deflection correcting wheel is arranged inside the banknote running passage and has a deflection correcting direction deviated with respect to a reference wall of the banknote running passage. Multiple deflection correcting wheels are provided, and the multiple deflection correcting wheels are dispersedly arranged in a conveying direction of the banknote running passage and are arranged to gradually close to the reference wall. An adjusting wheel having a guide direction along a guide direction of the reference wall is provided at the position of the reference wall, and the adjusting wheel is arranged between a first deflection correcting wheel and a second deflection correcting wheel in the multiple deflection correcting wheels. A linear speed of rotation of the adjusting wheel is greater than a linear speed of rotation of the respective deflection correcting wheel.

Preferably, in the deflection correcting device, the deflection correcting wheels are arranged at a middle of the banknote running passage and include three rows, and the three rows of the deflection correcting wheels have the same deflection correcting directions.

Preferably, in the deflection correcting device, a height of one side, close to the reference wall, of the banknote running passage is less than a height of another side, away from the reference wall, of the banknote running passage.

Preferably, in the deflection correcting device, the adjusting wheel is a polygonal adjusting wheel.

Preferably, in the deflection correcting device, deflection correcting floating pinch rollers are arranged in the banknote running passage and are in press fit with the respective deflection correcting wheels, and the deflection correcting floating pinch rollers and the deflection correcting wheels have the same deflection correcting directions.

Preferably, in the deflection correcting device, an adjustment floating pinch roller is arranged in the banknote running passage and configured to cooperate with the adjusting wheel, a clamping force between the adjusting wheel and the adjusting floating pinch roller is greater than a clamping force between the deflection correcting wheel and the respective deflection correcting floating pinch roller.

Preferably, in the deflection correcting device, an inlet of the banknote running passage is provided with multiple conveying wheels, rotation directions of the conveying wheels are along the guide direction of the banknote running passage, the multiple conveying wheels are arranged side by side on a driving shaft, and the driving shaft is provided with a gear pair for power transmission.

Preferably, in the deflection correcting device, the adjusting wheel is provided with a power transmission shaft, and the adjusting wheel is connected to the multiple deflection correcting wheels via a gear pair.

Preferably, in the deflection correcting device, a pressure adjusting screw configured to adjust the pressure between the deflection correcting wheel and the respective deflection correcting floating pinch roller is arranged on the deflection correcting floating pinch wheel, and a pressure adjusting screw configured to adjust the pressure between the adjusting wheel and the adjustment floating pinch roller is arranged on the adjustment floating pinch wheel.

An automatic teller machine is provided with an automatic banknote depositing apparatus, a deflection correcting device is arranged inside the automatic banknote depositing apparatus, and the deflection correcting device is the deflection correcting device according to any one of the above solutions.

The deflection correcting device according to the present application includes a banknote running passage formed by the first passage plate and the second passage plate; during the banknote depositing process, the banknotes pass through the banknote running passage between the two passage plates. A deflection correcting wheel is arranged inside the banknote running passage, and the deflection correcting direction of the deflection correcting wheel is deviated from a reference wall of the banknote running passage. There are multiple deflection correcting wheels, which are arranged dispersedly in the conveying direction of the banknote running passage and are gradually close to the reference wall. A guide adjusting wheel is provided at the position of the reference wall and has a guide direction along the reference wall, and the adjusting wheel is arranged between a first deflection correcting wheel and a second deflection correcting wheel in the multiple deflection correcting wheels. When being conveyed in the banknote running passage, the banknote is firstly conveyed by the deflection correcting wheels to gradually move close to the reference wall, and when getting close to the reference wall, the banknote is conveyed into the adjusting wheel and then is conveyed by the adjusting wheel and the deflection correcting wheels jointly, and the linear speed of rotation of the adjusting wheel is greater than the linear speed of rotation of the deflection correcting wheels. Since the conveying directions of the deflection correcting wheels are deviated from the reference wall, a front end of the banknote in the conveying direction gradually moves close to the reference wall, and at this moment, the banknote is corrected by the adjusting wheel with a greater linear speed, a top corner of the front end of the banknote gradually moves away from the reference wall, and a tail end of the banknote gradually moves close to the reference wall; and when the tail end of the banknote abuts against the reference wall, the banknote is continued to be conveyed and is adjusted to the right direction gradually, therefore the direct correction of the guide direction of the banknote is realized by the deflection correcting wheels, and the length of the banknote correction space is reduced, and the front end of the banknote is prevented from generating a sharp corner collision with the reference wall.

DETAILED DESCRIPTION

A deflection correcting device is provided by the present application, which decreases the banknote conveying space of the deflection correcting device. An automatic teller machine is further provided by the present application.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Figure 1:
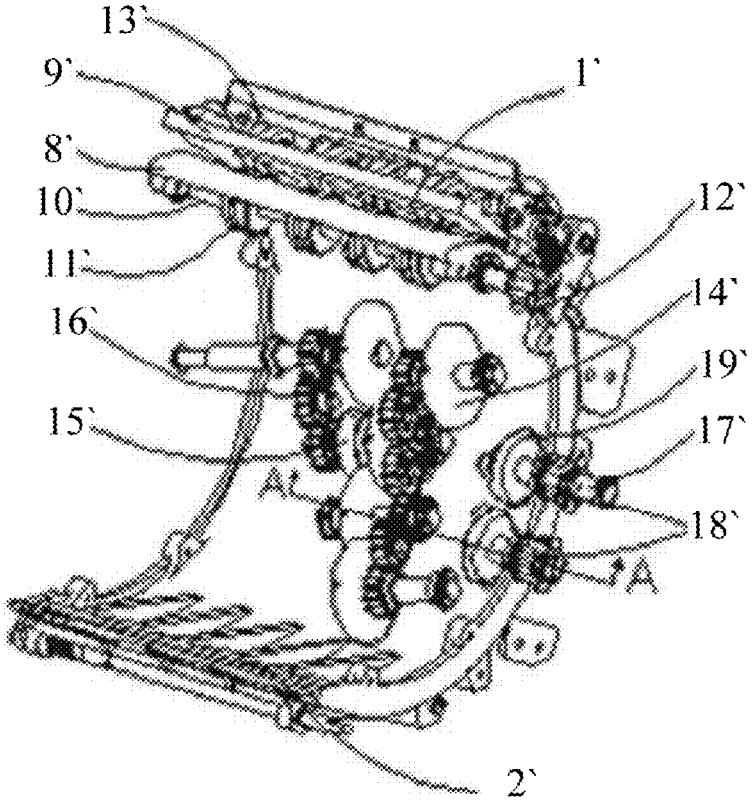
FIG. 1 is a schematic view showing the structure of a deflection correcting device in the conventional technology.
Figure 2:
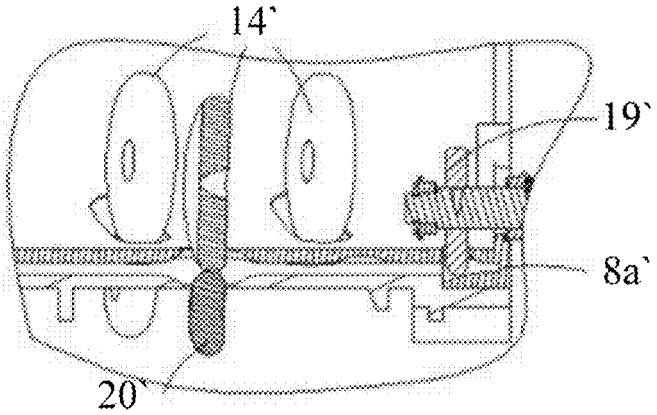
FIG. 2 is a sectional schematic view of FIG. 1 taken along the direction A-A.
Figure 3:
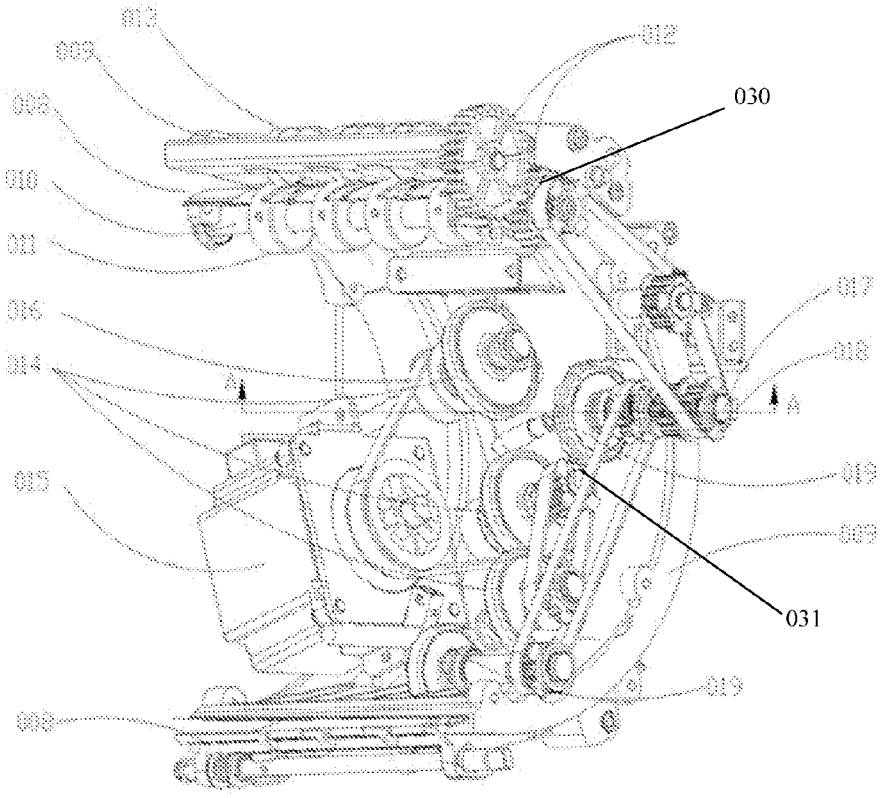
FIG. 3 is a schematic view showing the structure of a deflection correcting device according to the present application.
Figure 4:
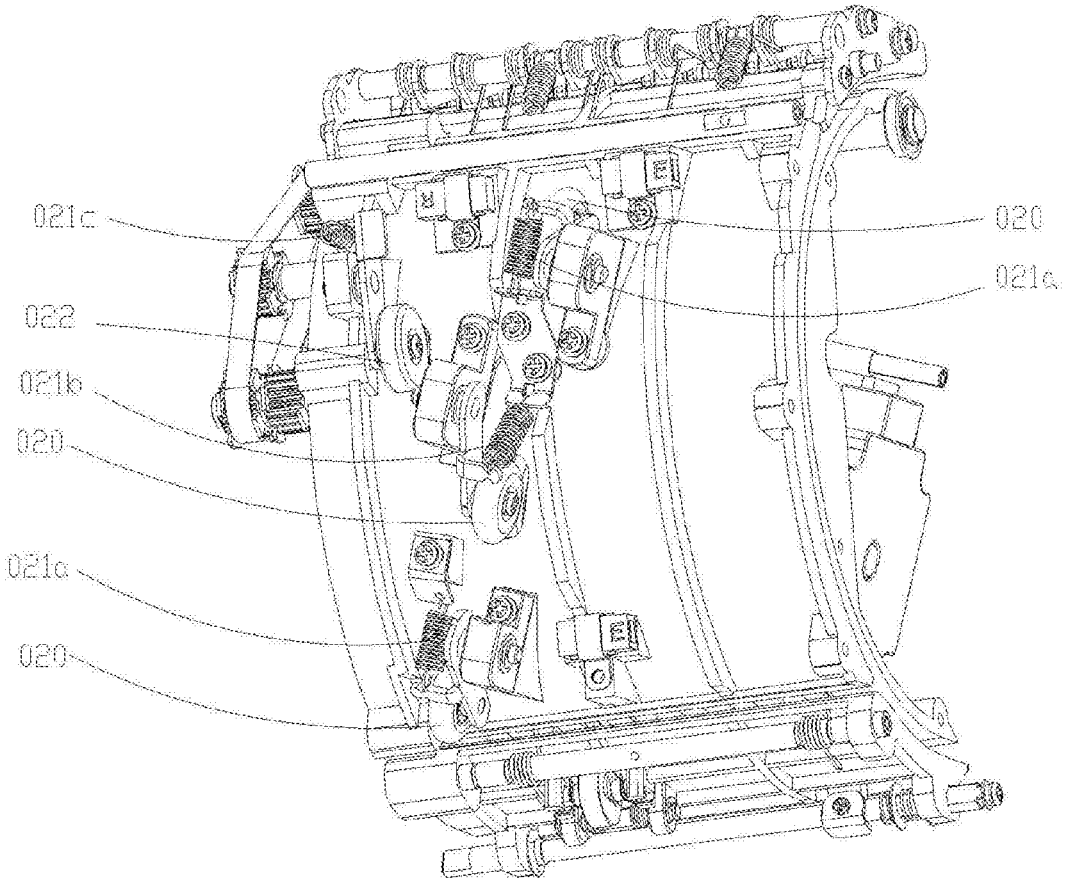
FIG. 4 is a schematic view showing the rear structure of FIG. 3.
Figure 5:
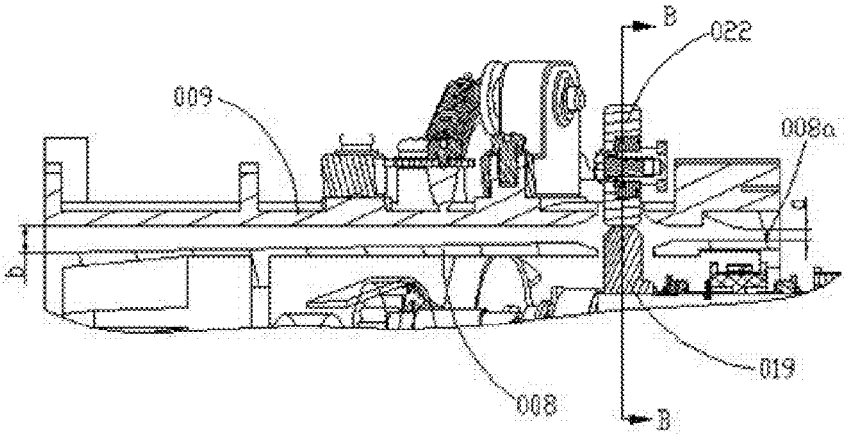
FIG. 5 is a schematic view showing the structure of FIG. 3 taken along the direction A-A.
Figure 6:
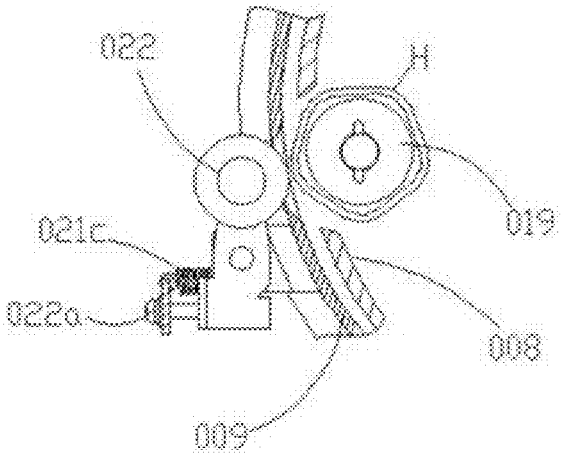
FIG. 6 is a schematic view showing the structure of FIG. 5 taken along the direction B-B.
Figure 7:
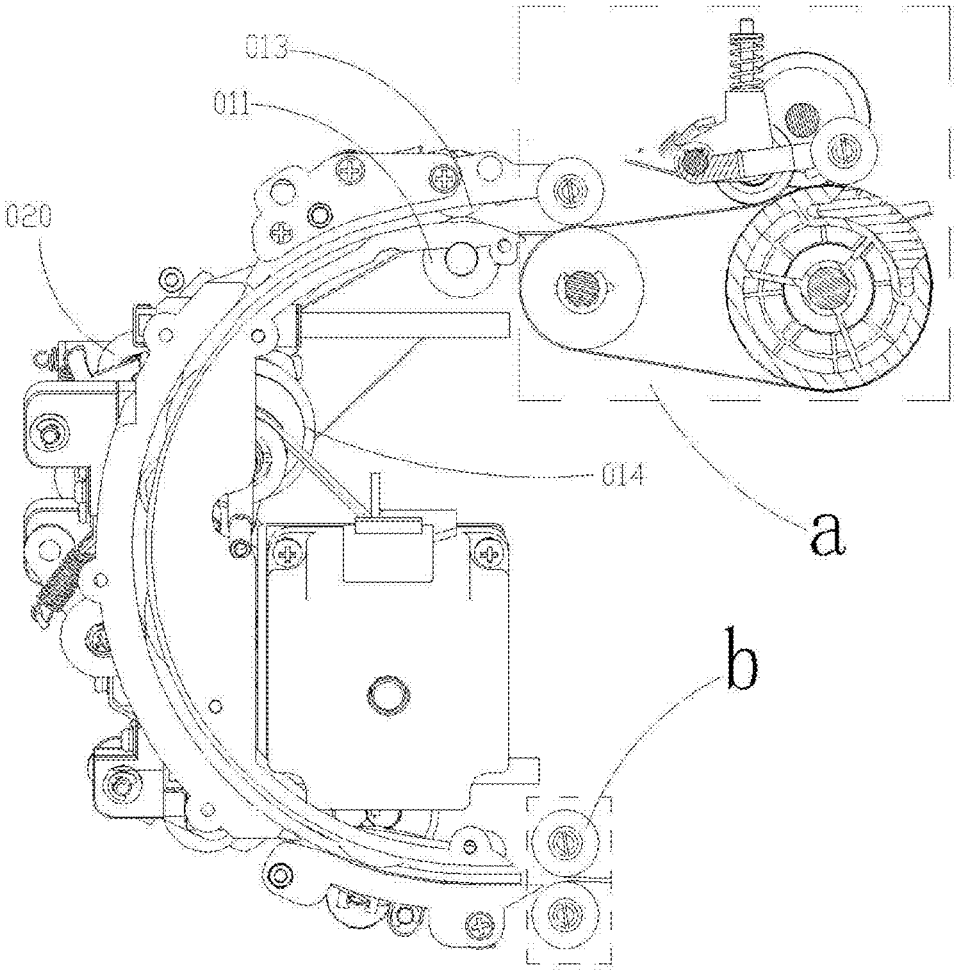
FIG. 7 is a schematic view showing the operating structure of the deflection correcting device according to the present application.

Reference is made to FIGS. 3 to 7, FIG. 3 is a schematic view showing the structure of a deflection correcting device according to the present application; FIG. 4 is a schematic view showing the rear structure of FIG. 3; FIG. 5 is a schematic view showing the structure of FIG. 3 taken along the direction A-A; FIG. 6 is a schematic view showing the structure of FIG. 5 taken along the direction B-B; and FIG. 7 is a schematic view showing the operating structure of the deflection correcting device according to the present application.

A deflection correcting device is provided by the present application, which includes a banknote running passage formed by a first passage plate 008 and a second passage plate 009, and during the banknote depositing process, the banknotes pass through the banknote running passage between the two passage plates. A deflection correcting wheel 014 is arranged inside the banknote running passage, and the deflection correcting direction of the deflection correcting wheel 014 is deviated from a reference wall **008*a* of the banknote running passage. There are multiple deflection correcting wheels 014, which are arranged dispersedly in the conveying direction of the banknote running passage and are gradually close to the reference wall 008***a*. The multiple deflection correcting wheels 014 are arranged dispersedly to form a multiple-row guide structure in the conveying direction, and one deflection correcting wheel is arranged in each row.

A guide adjusting wheel 019 is provided at the position of the reference wall 008*a* and has a guide direction along the reference wall 008*a*, and the adjusting wheel 019 is arranged between a first deflection correcting wheel and a second deflection correcting wheel in the multiple deflection correcting wheels 014. After being entered via an inlet of the banknote running passage, the banknote is conveyed by the deflection correcting wheels to gradually move close to the reference wall 008*a* and then is conveyed by the deflection correcting wheels 014 and the adjusting wheel 019 jointly in the banknote running direction.

When being conveyed in the banknote running passage, the banknote is firstly conveyed by the deflection correcting wheels 014 to gradually move close to the reference wall 008*a*, and when getting close to the reference wall 008*a*, the banknote is conveyed into the adjusting wheel 019 and then is conveyed by the adjusting wheel 019 and the deflection correcting wheels 014 jointly, and the linear speed of rotation of the adjusting wheel 019 is greater than the linear speed of rotation of the deflection correcting wheels 014. Since the conveying directions of the deflection correcting wheels 014 are deviated from the reference wall 008*a*, a front end of the banknote in the conveying direction gradually moves close to the reference wall 008*a*, and at this moment, the banknote is corrected by the adjusting wheel 019 with a greater linear speed, a top corner of the front end of the banknote gradually moves away from the reference wall 008*a*, and a tail end of the banknote gradually moves close to the reference wall 008*a;* and when the tail end of the banknote abuts against the reference wall 008*a*, the banknote is continued to be conveyed and is adjusted to the right direction gradually, therefore the direct correction of the guide direction of the banknote is realized by the deflection correcting wheels, and the correction length of the deflection correcting device is reduced, the top corner of the front end of the banknote is prevented from generating a sharp corner collision with the reference wall 008*a*, which further avoids the banknote from being curled in the banknote running passage to cause jam.

In a specific embodiment of the present application, the deflection correcting wheels 014 are arranged at the middle of the banknote running passage and include three rows, and the deflection correcting directions of the three rows of deflection correcting wheels are the same. During the process of the banknote being conveyed in the banknote running passage and gradually moving close to the reference wall 008*a*, the distance between the banknote and the reference wall 008*a* is gradually decreased. The three rows of deflection correcting wheels 014 are arranged at the middle and arranged gradually close to the reference wall 008*a*, thus the banknote put in the middle is conveyed to gradually move close to the reference wall, to correct the position of banknote as soon as possible. In the deflection correcting device according to the present application, the banknote has a fast correcting speed and a short correcting length, and the correction may be effectively completed by the design of three rows of deflection correcting wheels 014.

In a specific embodiment of the present application, the height of a side of the banknote running passage that is close to the reference wall 008*a* is less than the height of another side of the banknote running passage that is away from the reference wall 008*a*. In the banknote deflection correcting process, the banknote needs enough rigidity when in contact with the reference wall 008*a*. The banknote running passage formed by the first passage plate 008 and the second passage plate 009 is preferably embodied as an arc-shaped passage. The arc-shaped passage is used to convey the banknote and the height of the arc-shaped passage should not be too high due to the limitation of the thickness of the banknote. For avoiding the banknote running passage from being limited by folded banknotes in the conveying process, the structure of the banknote running passage is designed to have a high end and a low end, and in conjunction with the design of the arc-shaped passage, a cross section of the whole passage is made to have a tapered structure. Through the structural design of the banknote running passage having a gradually decreased height, a folded part of the banknote can be ensured to reach the reference wall 008*a* smoothly and be corrected by the reference wall 008*a* in the conveying process, and the position of the banknote is also limited in the thickness direction, to ensure the side of banknote has enough rigidness when this side of the banknote gets close to the reference wall.

In a specific embodiment of the present application, the adjusting wheel 019 is a polygonal adjusting wheel. The deflection state of the banknote is corrected by the polygonal adjusting wheel; and in the conveying process of the banknote, the deflection correcting wheels 014 and the adjusting wheel 019 jointly convey and correct the banknote, deflection correcting floating pinch rollers in press fit with the deflection correcting wheels are arranged in the banknote running passage, and the deflection correcting directions of the deflection correcting floating pinch rollers are the same as the deflection correcting directions of the deflection correcting wheels. Different springs are arranged on the floating pinch rollers, the floating pinch rollers, the springs and the deflection correcting wheels cooperate together to clamp the banknote tightly. The structure of the floating pinch roller of the adjusting wheel is the same as the structure of the floating pinch roller of the deflection correcting wheel.

Reference is made to FIGS. 4 to 6, FIG. 4 is a schematic view showing the rear structure of the deflection correcting device according to the present application; FIG. 5 is a schematic view showing the cross section of the deflection correcting device; and FIG. 6 is a sectional view of a part of the deflection correcting device corresponding to the adjusting wheel. Another side in the conveying direction corresponding to the deflection correcting wheels 014 is provided with floating pinch rollers 020, and the floating pinch rollers 020 are arranged at positions corresponding to respective deflection correcting wheels and are deviated by the same angle as the deflection correcting wheel. Being tensioned by the springs 021*a* and 021*b*, the floating pinch rollers 020 are always in contact with the deflection correcting wheels, to compress the banknote, thereby realizing the effect of conveying banknotes.

Under the action of a spring 021 c, an adjustment floating pinch roller 022 provides a clamping force to the banknote together with the adjusting wheel 019. A contact clearance between the adjustment floating pinch roller 022 and the adjusting wheel 019 may be adjusted by adjusting an adjusting screw 022*a*, to adjust the clamping force and to make it easy for the deflection correcting device to be compatible with banknotes of different specifications and qualities.

Reference is made to FIG. 7, which is a schematic view showing the operating structure of the deflection correcting device according to the present application.

After passing through a banknote separation device (a), the banknotes are continuously separated and conveyed piece by piece, and are arranged in the conveying passage at the same interval, and then are entered into the deflection correcting device. After entering into the deflection correcting device, each of the banknotes is clamped by a row of conveying wheels 011 arranged in the banknote conveying route at an inlet of the deflection correcting device and floating pinch rollers 013 arranged at another side of the passage corresponding to the conveying wheels 011, to provide power for conveying the banknotes.

When banknotes of different forms enter into the passage of the deflection correcting device, and are clamped by the deflection correcting wheels 014 and the floating pinch rollers 020, it should be ensured that the deflection correcting operation is not performed on the banknotes before the banknotes leave the conveying wheels 011, to avoid the banknotes from being untimely turned under the action of the deflection correcting wheels 014 and the floating pinch rollers 020, therefore the design here requires that a clamping force between the deflection correcting wheels 014 and the floating pinch rollers 020 must be less than a clamping force between the conveying wheels 011 and the floating pinch rollers 013. Only after the banknotes leave the conveying wheels 011 and the floating pinch rollers 013 and not clamped by them, the deflection correcting device may perform correction on the banknotes, and the banknotes are ultimately discharged by a discharging device (b).

After the banknote enters into the deflection correcting device, since the clamping force between the conveying wheel 001 at the inlet and the respective floating pinch roller 013 is greater than the clamping force of the deflection correcting wheels 014, the banknote will not be deviated at the beginning of the conveying process. After being disengaged from the conveying wheel at the inlet, the banknote is deviated under the action of the deflection correcting wheels and is guided by the adjusting wheel 019. Since the linear speed of the adjusting wheel 019 is greater than the linear speed of the deflection correcting wheel 014 in the banknote advancing direction, the speed of one side of the banknote that is close to the reference wall is greater than the speed of another side of the banknote, of course, the linear speed herein should be appropriately controlled, and the clamping force of the adjusting wheels 019 is designed to be greater than the clamping force of the deflection correcting wheels 014.

In this embodiment, a pressure adjusting screw configured to adjust the pressure between the deflection correcting wheel 014 and the deflection correcting floating pinch roller is arranged on the deflection correcting floating pinch wheel, and a pressure adjusting screw configured to adjust the pressure between the adjusting wheel 019 and the adjustment floating pinch roller is arranged on the adjustment floating pinch wheel. The clamping forces of the floating pinch rollers may be adjusted by the adjusting screws, to ensure that the clamping force of the adjusting wheel to the banknote is greater than the clamping force of the deflection correcting wheel to the banknote. When the banknote is clamped by the deflection correcting wheel 014 and the adjusting wheel 019, a movement instant center is formed at the clamping point of the deflection correcting wheel 014 due to the speed difference of two sides of the banknote, and the banknote rotates around the clamping point of the deflection correcting wheel instantaneously, and a front end of the banknote moves away from the reference wall 008*a* gradually until a rear end of the banknote comes into contact with the reference wall 008*a*. The above process doesn't require the banknote to leave the deflection correcting wheels.

After the top corner at the tail end of the banknote comes into contact with the reference wall 008*a*, the guide function of the adjusting wheel 019 is out of function, which makes the banknotes slip, and under the action of the deflection correcting wheels 014, the banknote is deviated to one side of the reference wall 008*a* by taking the contact point between the top corner at the tail end of the banknote and the reference wall 008*a* as an instant center. The linear speed of the adjusting wheel 019 is greater than the advancing speed of the banknote, and the adjusting wheel 019 is arranged at the side of the banknote that is away from the reference wall, thus under the action of the speed difference, the banknote is deviated by taking a certain point as the instant center, and the deviation direction is a direction close to the reference wall. Under the action of the above two deviation situations, the front end of the banknote is aligned to the reference wall rapidly, thereby accomplishing the deflection correction.

Through the coordinated correction function of the deflection correcting wheels 014 and the adjusting wheel 019 to the banknotes, the deflection correcting wheels 014 and the adjusting wheel 019 may convey the banknotes at the same time instead of the case that the adjusting wheel begins to correct the banknotes after the banknotes leave the first deflection correcting wheel, therefore the length of the passage of the deflection correction module is greatly decreased, which makes the structure of the deflection correcting device more compact and saves the space, and is easy to be installed on machines requiring a compact structure space.

In a specific embodiment of the present application, the inlet of the banknote running passage is provided with multiple conveying wheels 011, and the rotation direction of each of the conveying wheels 011 is along the guide direction of the banknote running passage, the conveying wheels 011 are arranged side by side on a driving shaft 010, and the driving shaft 010 is provided with a gear pair 012 for power transmission. The adjusting wheel 019 is provided with a power transmission shaft 017, and the adjusting wheel 019 and the multiple deflection correcting wheels 014 are connected via a gear pair. An interior of the deflection correcting device is provided with a power source and interrelated transmission structures. The driving shaft is transversely set up at the inlet of the deflection correcting device, four conveying wheels are arranged on the driving shaft at intervals and are each of a cylinder shape, and the banknotes are conveyed into the banknote running passage by the four conveying wheels. The driving shaft is provided with a gear pair, thus the power transmission among the deflection correcting wheels and the power transmission of the adjusting wheel can meet the predetermined requirements for the transmission speed and direction by designing a respective appropriate transmission ratio. Specifically, the rotation shaft is transversely set up at one side, corresponding to the reference wall, of the deflection correcting device, and the rotation shaft obtains power transmission via a transmission belt pulley, to drive the adjusting wheel and the deflection correcting wheels to rotate.

Based on the deflection correcting device according to the above embodiments, an automatic teller machine is further provided by the present application, which is provided with an automatic banknote depositing device. A deflection correcting device is arranged inside the automatic banknote depositing device, and the deflection correcting device is the deflection correcting device according to the above embodiments.

Since the automatic teller machine uses the deflection correcting device according to the above embodiments, the beneficial effects of the automatic teller machine brought by the deflection correcting device can refer to the above embodiments.

The above embodiments are described in a progressive manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A deflection correcting device, comprising a banknote running passage formed by a first passage plate and a second passage plate, and a deflection correcting wheel being arranged inside the banknote running passage and having a deflection correcting direction deviated with respect to a reference wall of the banknote running passage, wherein multiple deflection correcting wheels are provided, and the multiple deflection correcting wheels are dispersedly arranged in a conveying direction of the banknote running passage and are arranged to gradually close to the reference wall;

an adjusting wheel having a guide direction along a guide direction of the reference wall is provided at the position of the reference wall, and the adjusting wheel is arranged between a first deflection correcting wheel and a second deflection correcting wheel in the multiple deflection correcting wheels; and a linear speed of rotation of the adjusting wheel is greater than a linear speed of rotation of the respective deflection correcting wheel;

wherein deflection correcting floating pinch rollers are arranged in the banknote running passage and are in press fit with the respective deflection correcting wheels, and the deflection correcting floating pinch rollers and the deflection correcting wheels have the same deflection correcting directions; and wherein an adjustment floating pinch roller is arranged in the banknote running passage and configured to cooperate with the adjusting wheel, a clamping force between the adjusting wheel and the adjusting floating pinch roller is greater than a clamping force between the deflection correcting wheel and the respective deflection correcting floating pinch roller.

2. The deflection correcting device according to claim 1, wherein the deflection correcting wheels are arranged at a middle of the banknote running passage and comprise three rows, and the three rows of the deflection correcting wheels have the same deflection correcting directions.

3. The deflection correcting device according to claim 2, wherein a height of one side, close to the reference wall, of the banknote running passage is less than a height of another side, away from the reference wall, of the banknote running passage.

4. The deflection correcting device according to claim 1, wherein the adjusting wheel is a polygonal adjusting wheel.

5. The deflection correcting device according to claim 1, wherein an inlet of the banknote running passage is provided with multiple conveying wheels, rotation directions of the conveying wheels are along the guide direction of the banknote running passage, the multiple conveying wheels are arranged side by side on a driving shaft, and the driving shaft is provided with a gear pair for power transmission.

6. The deflection correcting device according to claim 5, wherein the adjusting wheel is provided with a power transmission shaft, and the adjusting wheel is connected to the multiple deflection correcting wheels via a second gear pair.

7. The deflection correcting device according to claim 6, wherein an adjusting screw configured to adjust the contact clearance between the adjusting wheel and the adjustment floating pinch roller is arranged on the adjustment floating pinch wheel.

8. An automatic teller machine, being provided with an automatic banknote depositing device, and a deflection correcting device being arranged inside the automatic banknote depositing apparatus, wherein the deflection correcting device comprises a banknote running passage formed by a first passage plate and a second passage plate, and a deflection correcting wheel is arranged inside the banknote running passage and having a deflection correcting direction deviated with respect to a reference wall of the banknote running passage, wherein multiple deflection correcting wheels are provided, and the multiple deflection correcting wheels are dispersedly arranged in a conveying direction of the banknote running passage and are arranged to gradually close to the reference wall;

an adjusting wheel having a guide direction along a guide direction of the reference wall is provided at the position of the reference wall, and the adjusting wheel is arranged between a first deflection correcting wheel and a second deflection correcting wheel in the multiple deflection correcting wheels; and a linear speed of rotation of the adjusting wheel is greater than a linear speed of rotation of the respective deflection correcting wheel;

wherein deflection correcting floating pinch rollers are arranged in the banknote running passage and are in press fit with the respective deflection correcting wheels, and the deflection correcting floating pinch rollers and the deflection correcting wheels have the same deflection correcting directions and wherein an adjustment floating pinch roller is arranged in the banknote running passage and configured to cooperate with the adjusting wheel, a clamping force between the adjusting wheel and the adjusting floating pinch roller is greater than a clamping force between the deflection correcting wheel and the respective deflection correcting floating pinch roller.

9. The automatic teller machine according to claim 8, wherein the deflection correcting wheels are arranged at a middle of the banknote running passage and comprise three rows, and the three rows of the deflection correcting wheels have the same deflection correcting directions.

10. The automatic teller machine according to claim 9, wherein a height of one side, close to the reference wall, of the banknote running passage is less than a height of another side, away from the reference wall, of the banknote running passage.

11. The automatic teller machine according to claim 8, wherein the adjusting wheel is a polygonal adjusting wheel.

12. The automatic teller machine according to claim 8, wherein an inlet of the banknote running passage is provided with multiple conveying wheels, rotation directions of the conveying wheels are along the guide direction of the banknote running passage, the multiple conveying wheels are arranged side by side on a driving shaft, and the driving shaft is provided with a gear pair for power transmission.

13. The automatic teller machine according to claim 12, wherein the adjusting wheel is provided with a power transmission shaft, and the adjusting wheel is connected to the multiple deflection correcting wheels via a second gear pair.

14. The automatic teller machine according to claim 13, wherein an-adjusting screw configured to adjust the contact clearance between the adjusting wheel and the adjustment floating pinch roller is arranged on the adjustment floating pinch wheel.

* * * * *